US005962984A

United States Patent [19]

Mashburn, III et al.

[11] Patent Number: 5,962,984

[45] Date of Patent: Oct. 5, 1999

[54] HIGH INTENSITY LIGHTING CIRCUIT

[75] Inventors: Morris W. Mashburn, III, Brentwood, Tenn.; William Peil, North Syracuse, N.Y.

[73] Assignee: Morris W. Mashburn, III, Brentwood, Tenn.

[21] Appl. No.: 09/005,848

[22] Filed: Jan. 12, 1998

[51] Int. Cl.[6] ..... H05B 37/00

[52] U.S. Cl. ..... 315/200 A; 315/205; 315/246; 315/314

[58] Field of Search ..... 315/200 A, 200 R, 315/205, 225, 241 P, 241 S, 265, 246, 314, 315, 97, 307

[56] References Cited

U.S. PATENT DOCUMENTS

| | | | |
|---|---|---|---|
| 2,917,668 | 12/1959 | Witterson | 315/171 |
| 3,115,594 | 12/1963 | Mallory | 315/219 |
| 3,480,831 | 11/1969 | Wuerker et al. | 315/241 |
| 3,921,035 | 11/1975 | Holmes | 315/307 |
| 3,943,397 | 3/1976 | Yancey | 315/317 |
| 4,243,917 | 1/1981 | Caprari | 315/241 R |
| 4,325,008 | 4/1982 | Borland et al. | 315/241 R |
| 5,107,292 | 4/1992 | Tanaka et al. | 354/416 |
| 5,150,012 | 9/1992 | Pringle et al. | 315/200 A |
| 5,180,953 | 1/1993 | Hirata et al. | 315/241 S |
| 5,184,171 | 2/1993 | Uenishi | 354/416 |
| 5,436,427 | 7/1995 | Bourque | 219/130.1 |
| 5,497,001 | 3/1996 | Filo | 250/316.1 |
| 5,523,654 | 6/1996 | Sikora et al. | 315/241 R |
| 5,570,077 | 10/1996 | Swieboda | 340/331 |
| 5,602,522 | 2/1997 | Pacelli | 340/331 |
| 5,640,061 | 6/1997 | Bornhorst et al. | 307/150 |

*Primary Examiner*—Don Wong
*Assistant Examiner*—Haissa Philogene
*Attorney, Agent, or Firm*—Finnegan, Henderson, Farabow, Garrett & Dunner

[57] ABSTRACT

To provide a high intensity lighting circuit of improved efficiency and reduced electromagnetic interference generation, a DC xenon lamp is driven by a three phase AC source through a three phase, full wave bridge rectifier.

14 Claims, 1 Drawing Sheet

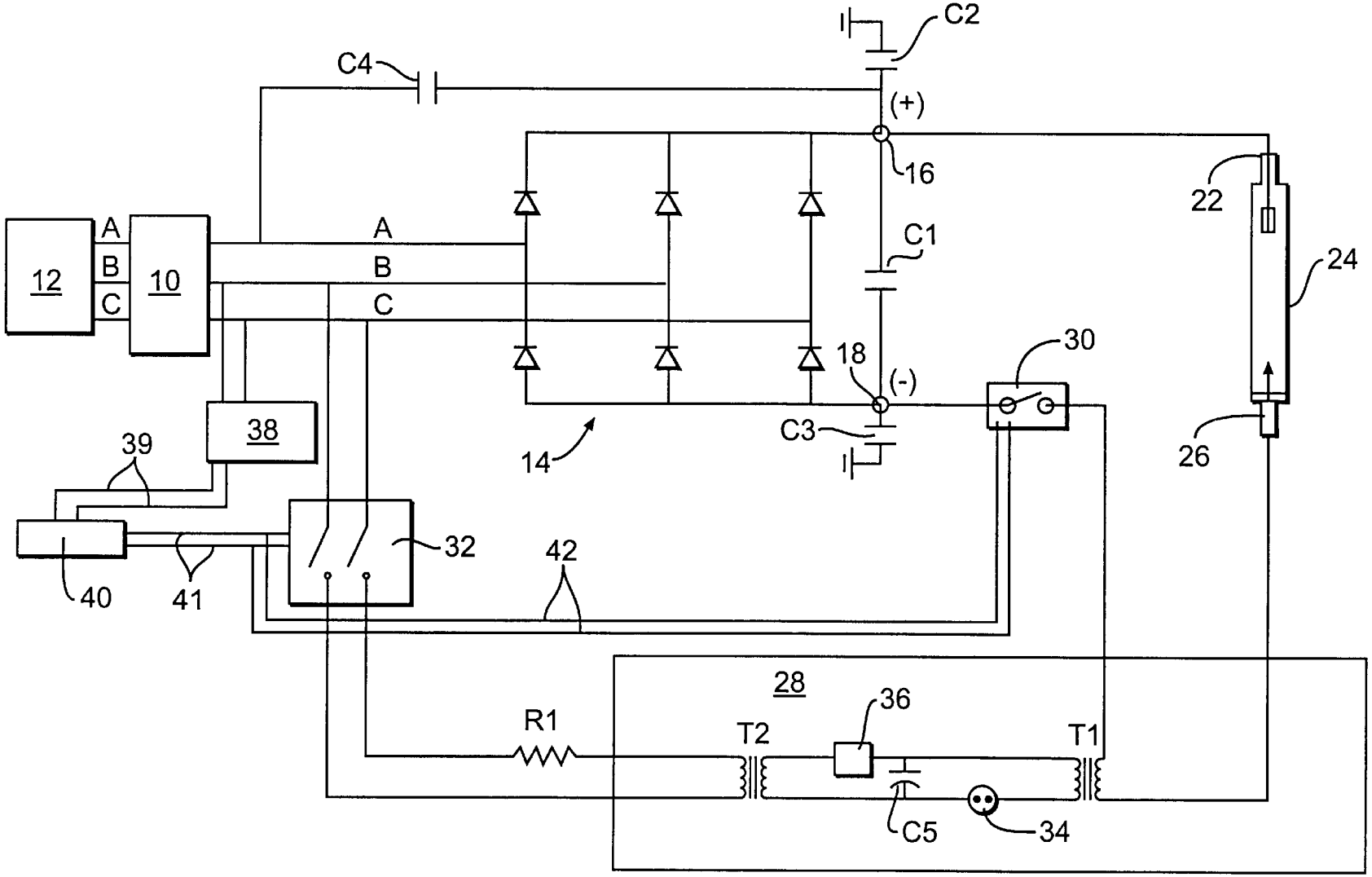
24
22
26
30
C2
(+)
16
C1
(-)
18
C3
T1
34
C5
36
28
T2
14
42
R1
32
C4
A
B
C
38
10
12
39
41
40

HIGH INTENSITY LIGHTING CIRCUIT

FIELD OF THE INVENTION

The present invention relates to the production of high levels of intense light, e.g. 25 kw–1000 kw, having applications in numerous fields, such as flash photography, solid state laser pumps, entertainment special effects, stroboscopes, and solar flash simulators.

BACKGROUND OF THE INVENTION

In the application to which the present invention is particularly directed, entertainment special effects lighting, high intensity light to simulate lightning, for example, was initially produced by drawing an arc between carbon electrodes connected in a high voltage DC circuit. With the advent of high intensity lamps, such as xenon lamps, drive circuits were developed to drive these lamps in a pulsed mode to produce bursts of high intensity simulating lightning bolts. As exemplified by Pringle et al., U.S. Pat. No. 5,150,012, such drive circuits have been AC drive circuits. To achieve pulsed operation, high power AC switches, such as triacs, are required. Triacs, while capable of handling the high levels of voltage and current involved, are notorious radiators of EMI (electromagnetic interference), which raises havoc with any associated electronic equipment. Triacs also produce undesirable AC waveform distortion.

SUMMARY OF THE INVENTION

It is an objective of the present invention to overcome at least some of the disadvantages and drawbacks of the prior art. To achieve this objective, in accordance with the present invention, there is provided a high intensity lighting circuit comprising a circuit breaker having three phase inputs for connection to a three phase AC source and three phase outputs connected to inputs of a three phase full wave rectifying bridge network having first and second DC output terminals. A high intensity DC lamp has a first electrode connected to the first DC output terminal and a second electrode connected to the second DC output terminal through an ignitor having power inputs connected to at least one of the three phase outputs of the circuit breaker.

Additional features and advantages of the invention will be set forth in the description that follows, and, in part, will be apparent from the description, or may be learned from practice of the invention. The objectives and other advantages of the invention will be realized and attained by the apparatus particularly pointed out in the written description and claims hereof, as well as the appended drawings.

It is to be understood that the foregoing general description and the following detailed description are exemplary and explanatory and are intended to provide further explanation of the invention defined in the appended claims.

BRIEF DESCRIPTION OF THE DRAWINGS

The accompanying drawings, which are incorporated in and constitute a part of this specification, illustrate embodiments of the invention and, together with the following detailed description, serve to explain the objectives, advantages, and principles of the invention.

The sole FIGURE of the drawing is a circuit diagram of a high intensity lighting circuit in accordance with a presently preferred embodiment of the present invention.

DETAILED DESCRIPTION OF THE INVENTION

A high intensity lighting circuit consistent with the present invention, as illustrated in the drawing, includes a three phase circuit breaker 10 connected to a three phase AC source 12, which may have an output voltage of, for example, 208, 240, or 480 volts. This circuit breaker would typically be equipped to provide overcurrent protection. When circuit breaker 10 is closed, the three phases A, B, and C of source 12 are rectified by a full wave bridge network, generally indicated at 14, to produce a positive DC output voltage on terminal 16 and a negative DC output voltage on terminal 18.

The positive bridge output terminal 16 is connected to one electrode 22 of a DC xenon lamp 24, while negative bridge output terminal 18 is connected to the other electrode 26 of the xenon lamp through an ignitor 28 and a single pole electronically controlled switch, such as a solid state relay 30. This solid state relay may be an insulated gate, bipolar transistor DC power switch, and thus avoids the drawback of triacs. A solid state relay suitable for application in the present invention is commercially available from Gentron of Scottsdale, Ariz. under the designation IGTD 600240R100.

An ignitor 28 suitable for application in the present invention is a Model 4675 manufactured by L.P. Associates of Hollywood, Calif. The AC power input for ignitor 28 is obtained from two of the three phase outputs of circuit breaker 10 through a two pole relay 32, which may be a conventional electromagnetic relay. A current limiting resistor R1 may be connected into the ignitor power input circuit.

As illustrated in the drawing, ignitor 28 includes a step up input transformer T2 having its primary winding connected to AC power inputs from two phase outputs of circuit breaker 10 through electromagnetic relay 32 when closed. The high AC voltage induced in the secondary winding of input transformer T2 charges capacitor C5 to a high voltage sufficient to break down spark gap 34. Current then flows in a resonant circuit including capacitor C5, secondary winding of input transformer T2, and primary winding of step up output transformer T1, resulting in a series of damped oscillations at two to four MHZ during each half cycle of the AC source frequency. These high frequency damped oscillations in the primary winding of output transformer T1 induce high frequency, high voltage pulses in the secondary winding of transformer T1, which are superimposed on the DC voltage applied to lamp terminal 26 when solid state relay 30 is closed. An arc is then struck in lamp 24 when sufficient voltage is developed across lamp electrodes 22, 26, and lamp 24 ignites to generate a high intensity light output. Since lamp current flows through the secondary winding of output transformer T1, its winding resistance should be low (0.5 to 2 milliohms) to prevent excessive power dissipation and thus undue heating in ignitor 28. The RF trap 36 in the secondary circuit of input transformer T2 minimizes RF leakage back into the lamp power circuit and AC source 10.

A filtering capacitor C1 is connected across the bridge output terminals 16 and 18. A bypass capacitor C2 is connected between bridge output terminal 16 and ground, while a bypass capacitor C3 is connected between bridge output terminal 18 and ground. Capacitors C2 and C3 provide transient and EMI suppression. A voltage multiplication capacitor C4 is connected from bridge output terminal 16 back to one of the phase outputs of circuit breaker 10.

As further illustrated in the drawing, a power supply 38, connected to tap power from two of the three phase inputs to bridge 14, produces low voltage DC power on wires 39 running to a remote controller 40. This controller is connected to electromagnetic relay 32 via wires 41 and to solid state relay 30 via wires 42. When lamp 24 is to be fired to generate an intense light output, a firing switch (not shown) in remote controller 40 is closed to produce triggering outputs on wires 41 and 42 effecting concurrent closures of electromagnetic relay 32 to supply AC input power to the primary winding of transformer T2 in ignitor 28 and of solid state relay 30 to complete the lamp power from bridge network output terminal 18 to lamp electrode 26 through the secondary winding of output transformer T1 in the ignitor. It will be appreciated that solid state relay 30 may take the form of a controlled conduction semiconductor power switch, capable of assuming not only on and off states, but also a variable conduction state determined by the triggering signal level received from remote controller 40. This third state would provide the capability of varying the light output of lamp 24 from the remote controller 40.

It will be appreciated that on/off control of the lamp circuit could be achieved by connecting a three pole AC solid state relay between circuit breaker 12 and the inputs to bridge network 14, with input power to ignitor 28 tapped from the outputs of the solid state relay. However, it is considered preferable to utilize a single pole DC solid state relay 30 in the DC output side of bridge network 14, which is a significantly less expensive approach than a three pole AC solid state relay. This is so, even though utilization of single pole DC solid state relay 30 requires the addition of electromagnetic relay 32 for separate on/off control of ignitor 20.

Remote 40 may be a handheld unit that is manually operated to produce an intense light burst from lamp 24 for durations of ranging from milliseconds to two seconds. Alternatively, remote 40 may be in the form of a numerical controller programmed to automatically produce randomly timed sequences of intense light flashes from lamp 24 simulating lightning or other special lighting effects in timed coordination with other special effects components of a theatrical or motion picture production.

Inasmuch as the present utilizes a three phase AC source, the output voltage of three phase full wave rectifying bridge network 14 is essentially DC with little ripple. Consequently, it is possible to use DC xenon lamp 24, rather than an AC xenon lamp typically used when the drive circuit is powered from a single phase AC source. In the latter case, during dips in the lamp driving voltage, the ignitor may be required to restart the lamp, which produces severe EMI that raises havoc with other loads connected to the single phase AC source.

Lamp 24 may be a long arc DC lamp including, for example, a standard quartz envelope containing xenon gas at a fill pressure of 50 to 200 torr, a bore of 26 mm, and an arc length of 24 inches. The tungsten electrodes are dimensioned to carry large currents, e.g. 50–1000 amps, and have a low workload function coating. The foregoing lamp specifications will vary depending upon the magnitude of light output the lamp is to generate.

It will be apparent to those skilled in the art that various modifications and variations can be made in the high intensity lighting circuit of the present invention and in the illustrated constructions thereof without departing from the scope or spirit of the invention.

Other embodiments of the invention will be apparent to those skilled in the art from consideration of the specification and practice of the invention disclosed herein. It is therefore intended that the specification and drawings be considered as exemplary only, with the true scope and spirit of the invention being indicated by the following claims.

What is claimed is:

1. A high intensity lighting circuit comprising:

a circuit breaker having three phase inputs for connection to a three phase AC source and corresponding three phase outputs;

a three phase full wave rectifying bridge network having inputs connected to the three phase outputs of the circuit breaker and first and second DC output terminals;

a high intensity DC lamp having a first electrode connected to the first DC output terminal, and a second electrode; and an ignitor connected between the second lamp electrode and the second DC output terminal and having power inputs connected to at least one phase output of the circuit breaker three phase outputs.

2. The high intensity lighting circuit defined in claim 1, wherein the high intensity lamp is a xenon lamp.

3. The high intensity lighting circuit defined in claim 1, further comprising a first capacitor connected across the first and second DC output terminals.

4. The high intensity lighting circuit defined in claim 3, further comprising second and third capacitors respectively connecting the first and second DC output terminals to ground.

5. The high intensity lighting circuit defined in claim 4, further comprising a fourth capacitor connecting the first DC output terminal to one of the three phase outputs of the circuit breaker.

6. The high intensity lighting circuit defined in claim 1, further comprising a switch connected in series with the ignitor between the second lamp electrode and the second DC output terminal.

7. The high intensity lighting circuit defined in claim 6, wherein the high intensity lamp is a xenon lamp.

8. The high intensity lighting circuit defined in claim 6, further comprising a relay connected in series circuit with the ignitor power inputs.

9. The high intensity lighting circuit defined in claim 8, further comprising a remote controller coupled to open and close the switch and the relay in concert.

10. The high intensity lighting circuit defined in claim 9, further comprising a power supply connected to at least one of the three phase circuit breaker outputs for producing low voltage DC power coupled to the remote controller for enabling the remote controller to open and close the switch and the relay.

11. The high intensity lighting circuit defined in claim 9, wherein the switch is a single pole insulated gate bipolar transistor switch.

12. The high intensity lighting circuit defined in claim 9, further comprising a first capacitor connected across the first and second DC output terminals.

13. The high intensity lighting circuit defined in claim 12, further comprising second and third capacitors respectively connecting the first and second DC output terminals to ground.

14. The high intensity lighting circuit defined in claim 13, further comprising a fourth capacitor connecting the first DC output terminal to one of the three phase outputs of the circuit breaker.

* * * * *